US006118377A

United States Patent [19]

Bonkowski et al.

[11] Patent Number: 6,118,377

[45] Date of Patent: Sep. 12, 2000

[54] CONDUCTIVE SECURITY ARTICLE WITH DETECTOR APPARATUS

[75] Inventors: Richard L. Bonkowski; Christopher W. Lantman, both of Santa Rosa, Calif.

[73] Assignee: Flex Products, Inc., Santa Rosa, Calif.

[21] Appl. No.: 09/094,090

[22] Filed: Jun. 9, 1998

[51] Int. Cl.[7] ..... B42D 15/10; G08B 13/14

[52] U.S. Cl. ..... 340/572.1; 340/568.1; 283/70; 283/83

[58] Field of Search ..... 340/568.1, 572.1, 340/825.31; 283/70, 83; 235/375, 380, 382

[56] References Cited

U.S. PATENT DOCUMENTS

| | | | |
|---|---|---|---|
| 4,231,593 | 11/1980 | Bell, Jr. et al. . | |
| 4,579,371 | 4/1986 | Long et al. | 283/83 |
| 5,112,672 | 5/1992 | Kaule et al. . | |
| 5,149,386 | 9/1992 | Smits et al. . | |
| 5,176,405 | 1/1993 | Kaule et al. . | |
| 5,267,754 | 12/1993 | Kaule . | |
| 5,399,403 | 3/1995 | Instance . | |
| 5,471,039 | 11/1995 | Irwin, Jr. et al. | 325/441 |
| 5,477,219 | 12/1995 | Zarembo et al. . | |
| 5,566,982 | 10/1996 | Lehureau et al. . | |
| 5,574,470 | 11/1996 | de Vall . | |
| 5,631,039 | 5/1997 | Knight et al. . | |
| 5,690,366 | 11/1997 | Luciano . | |
| 5,697,649 | 12/1997 | Dames et al. . | |
| 5,720,500 | 2/1998 | Okazaki et al. . | |
| 5,751,256 | 5/1998 | McDonough et al. . | |
| 5,818,019 | 10/1998 | Irwin, Jr. et al. . | |

FOREIGN PATENT DOCUMENTS 753 623 A2 1/1997 European Pat. Off. .

*Primary Examiner*—Daniel J. Wu
*Attorney, Agent, or Firm*—Workman, Nydegger & Seeley

[57] ABSTRACT

A security system includes a security article and a corresponding detector. The security article comprises a substrate layer having a top surface and a bottom surface. The substrate layer is composed of an electrically nonconductive material. Deposited on the top surface of the substrate layer is a conductive thin film coating having a predetermined electrical resistance between two spaced apart points. In one embodiment, the conductive thin film coating is comprised of a transparent conductive compound and has a thickness in a range between about 7 nanometers to about 700 nanometers. Printing can be positioned either on top of the substrate layer or on top of the thin film coating. The detector corresponds to the security article and has a light source and a pair of spaced apart probes. The detector contains electrical circuitry configured to energize the light source when an electrical resistance is produced between the probes that corresponds to the predetermined electrical resistance for the security article.

20 Claims, 3 Drawing Sheets

CONDUCTIVE SECURITY ARTICLE WITH DETECTOR APPARATUS

BACKGROUND OF THE INVENTION

1. The Field of the Invention

The present invention relates to conductive articles, and more specifically articles having a conductive thin film coating with a predetermined electrical resistance and detectors for authenticating the predetermined electrical resistance.

2. Present State of the Art

As the technology in photocopiers, printers, and computers increases, the occurrence of sophisticated counterfeiting also increases. Counterfeiting runs a gambit much larger than just monetary notes. For example, counterfeiting can also be traced to credit cards, identification cards, coupons, tickets, legal documents, and other valuable papers. To combat counterfeiting, governments and other companies have developed unique approaches for distinguishing and authenticating original articles. Such approaches include manufacturing articles out of unique compositions and also incorporating water marks, colored threads, and intricate designs using novel ink compositions.

Although current approaches are useful in discouraging and discovering counterfeiting, such approaches are typically expensive to develop and apply. Furthermore, it is often apparent to the counterfeiter what unique aspect of an article needs to be duplicated in order to match an original article. For example, although colored threads are useful in authenticating original bills, counterfeiters are clearly aware of the presence of colored threads and thus can attempt to duplicate such threads.

A problem related to counterfeiting is that of tampering. For example, tampering with bottled drugs is a continuing concern to the public. Tampering also relates to the seal on envelopes and to other types of seals on important articles or papers. Although shrink wrap seals have relieved much of the public concern on many items, such seals can be easily replaced.

OBJECTS AND BRIEF SUMMARY OF THE INVENTION

Accordingly, it is an object of the present invention to provide articles that minimize counterfeiting and tampering.

Another object of the present invention is to provide articles as above that have a distinctive feature for authenticating the article wherein the distinctive feature is not readily apparent to a counterfeiter or someone tampering with the article.

Yet another object of the present invention is to provide discrete apparatus for authenticating the distinctive feature of the above articles.

Finally, it is another object of the present invention to provide articles and apparatus as above which require sophistication to produce but do not dramatically increase the cost or expense of the article.

To achieve the foregoing objects, and in accordance with the invention as embodied and broadly described herein, a security system is provided that includes a conductive security article that can be authenticated by a corresponding detector. The security article comprises a substrate layer having a top surface and a bottom surface. The substrate layer can include a sheet-like material such as those commonly made of plastic or paper. Alternatively, the substrate layer can comprise a portion of an article such as a bottle, box, bag, or other type of container. In one embodiment, it is preferred that the substrate layer be an electrically non-conductive material such as plastic or paper.

Deposited on the top surface of the substrate layer is a conductive thin film coating (TFC) having a thickness in a range between about 7 nanometers to about 700 nanometers. In one embodiment, the TFC is comprised of a transparent conductive compound such as indium tin oxide or silver oxide. In alternative embodiments, the TFC can comprise one of a variety of different opaque metals such as nickel, stainless steel, or aluminum. The TFC can be deposited on the substrate layer using chemical vapor deposition or physical vapor deposition. Alternatively, the TFC can be applied by incorporating the conductive materials as discussed above into a lacquer or resin that does not degrade the conductive material. The resulting composition can then be painted or printed over the substrate layer.

If desired, printing, such as letters or designs, can be positioned on the top surface of the substrate layer. The TFC can then be applied over the printing. In this embodiment, it is beneficial that the TFC be a transparent material. The printing can also be applied over a portion of the TFC.

The security article can have the configuration of a variety of different objects. For example, the security article can comprise a ticket, note, identification card or other valuable document. The article can also comprise a bottle, box, bag, or other type of container on which the TFC may cover all or only a small portion thereof. It is also envisioned that the security article can comprise a label which is placed on a desired product. In this embodiment, the substrate layer can comprise conventional label stock. Positioned on the bottom surface of the substrate layer is an adhesive for securing the label to the desired product.

By preselecting factors such as the thickness and material composition of the TFC, the TFC can be formed having a predetermined electrical resistance between two points separated by a defined distance. Likewise, by varying the above factors, including the spacing between the separated points, the TFC can be formed having virtually any predetermined resistance. This predetermined resistance is an authenticating property of the security article or of the product on which the security article is placed. That is, by making a specific security article have a unique and specific resistance, the resistance becomes a unique property of the article which can be used to authenticate the article.

Authenticating of a security article is achieved by a detector. The detector comprises a housing having electrical circuitry disposed therein. Rigidly projecting from the housing are a pair of spaced apart probes. The probes are separated at a distance corresponding to the defined distance required to obtain the predetermined electrical resistance on the TFC. A battery positioned within the housing produces a voltage differential between the probes. Mounted on the housing is a light or other indicator.

The electrical circuitry of the detector, which is coupled to the probes, is configured to correspond to the expected or predetermined resistance that will be produced by the TFC when the probes are biased thereagainst. That is, the electrical circuitry is configured such that when the probes of the detector are biased against the TFC, the light of the detector is energized if the actual resistance produced by the TFC between the probes corresponds to the predetermined resistance. Energizing of the light thus authenticates the security article. If the security article has been counterfeited and the counterfeited article does not have a TFC or if the TFC does not have the predetermined resistance, the light will not energize when the probes are biased thereagainst, thereby identifying that the article is a counterfeit or at least has been tampered with.

The present invention has several unique advantages. For example, although the TFC has a physical presence, it is not apparent to a counterfeiter that the TFC has an authenticating electrical resistance. This is particularly true when a transparent TFC is used. In this case, the TFC can simply look like a plastic sheet. Accordingly, the present invention is unique in that it provides an authenticating feature of which a counterfeiter may not even be aware.

Furthermore, even if a counterfeiter were aware of the conductive TFC, the counterfeiter would not necessarily know the predetermined resistance that the TFC should produce. In addition, production of a TFC in a thickness range between about 7 nanometers to about 700 nanometers requires specialized equipment that is not easily obtainable and operated by a counterfeiter. Nevertheless, because the TFC is so thin, the cost of applying the TFC to articles would not be prohibitively expensive to a legitimate mass producer of security articles.

These and other objects, features, and advantages of the present invention will become more fully apparent from the following description and appended claims, or may be learned by the practice of the invention as set forth hereinafter.

BRIEF DESCRIPTION OF THE DRAWINGS

In order to show the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
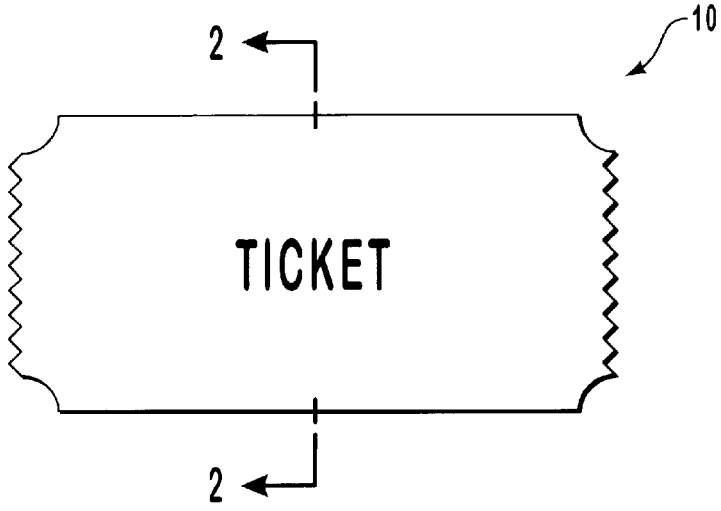
FIG. 1 is a top plan view of a security article in the shape of a ticket.

Depicted in FIG. 1 is one embodiment of a security article 10 incorporating features of the present invention. In the embodiment depicted, security article 10 is in the form of a ticket. The ticket can be used in any manner that conventional tickets are used. As will be discussed later in greater detail, security article 10 can have a variety of different configurations.

Figure 2:
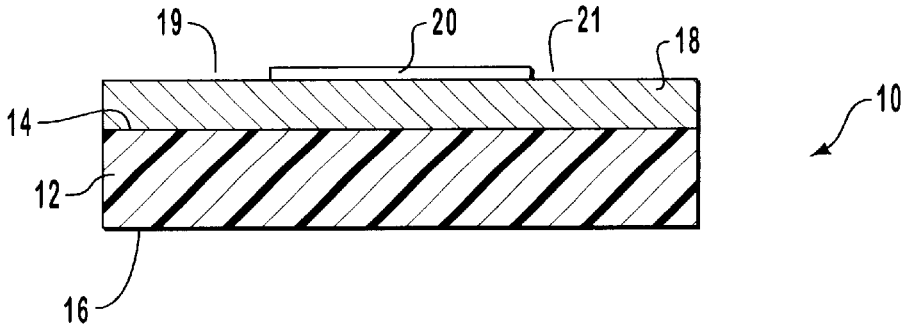
FIG. 2 is a cross-sectional side view of the security article shown in FIG. 1.

Depicted in FIG. 2 is a cross-sectional side view of security article 10. As depicted therein, article 10 comprises a substrate layer 12 having a top surface 14 and a bottom surface 16. In one embodiment, substrate layer 12 has a flexible sheet-like configuration having a thickness in a range between about 10 microns to about 100 microns with about 10 microns to about 50 microns being more preferred. Examples of such sheets include conventional paper stock and plastic sheets. In alternative embodiments, substrate layer 12 need not be limited by thickness, size, or flexibility. For example, substrate layer 12 can comprise the side wall or portion of a bottle, bag, box, shell, envelope, or other type of container.

In one preferred embodiment, substrate layer 12 is comprised of an electrically nonconductive material. Examples of electrically nonconductive materials include paper, composites, and plastics such as polyester and polypropylene. In one embodiment, it is preferred that substrate layer 12 be transparent. In alternative embodiments, substrate layer 12 need not be electrically nonconductive. In these embodiments, however, an insulating layer needs to be applied on top surface 14 of article 10 for reasons as discussed below in greater detail.

Deposited on top surface 14 of substrate layer 12 is a conductive thin film coating (TFC) 18. In one embodiment, TFC 18 is comprised of a transparent conductive compound. Examples of transparent conductive compounds include indium tin oxide, silver oxide and conductive polymers such as polyphenylene. In another embodiment, TFC 18 is comprised of an opaque conductive element or compound such as nickel, aluminum, and stainless steel. TFC 18 typically has a resistivity in a range between about 10 ohms/square to about 1000 ohms/square. TFC 18 can be applied to substrate layer 12 using conventional deposition processes common in the chip manufacturing industry. For example, TFC 18 can be deposited using physical vapor deposition (PVD), chemical vapor deposition (CVD), or solution casting.

Transparent conductive compounds are typically deposited having a thickness in a range between about 10 nanometers to about 700 nanometers. Opaque conductive materials are typically deposited having a thickness in a range between about 7 nanometers to about 200 nanometers. As the thickness of opaque conductive materials decreases, the opaque conductive materials become more transparent. Accordingly, in one embodiment it is preferred that the opaque conductive materials be deposited having a thickness in a range between about 7 nanometers to about 20 nanometers.

Producing TFC 18 in a transparent form has several advantages. Most notably, when TFC 18 is transparent, TFC 18 becomes a covert authenticating feature of article 10. That is, a transparent TFC 18 is not noticeably visible to a consumer or counterfeiter. Accordingly, a counterfeiter would not be aware of the need to replicate TFC 18. TFC 18 thus functions to authenticate an article both by its physical presence and, as discussed below, by its electrical resistance.

TFC 18 can be deposited so as to cover any desired size of surface area. To facilitate easy use with a detector, as will be discussed later, in one embodiment TFC 18 covers a surface area in a range between about 0.5 $cm^2$ to about 10 $cm^2$ with about 1 $cm^2$ to about 5 $cm^2$ being more preferred. If desired, substrate layer 12 can be designed to cover a comparable surface area.

Rather than applying TFC 18 using a deposition process, TFC 18 can also be painted on using air or airless spraying apparatus or can be applied using a printing apparatus. In this embodiment, the above transparent and opaque materials are incorporated into a matrix material, such as a lacquer or varnish, which does not degrade the conductive material. The matrix material can include, by way of example and not by limitation, conventional ink resins, acrylics, and/or polyurethanes. In this embodiment, TFC 18 typically has a thickness in a range between about 200 nanometers to about 500 nanometers.

By preselecting factors such as the thickness and material composition of TFC 18, TFC 18 can be formed having a predetermined electrical resistance between two points separated by a defined distance. Likewise, by varying the above factors, including the spacing between the separated points, the TFC can be formed having virtually any predetermined resistance. In one embodiment, TFC 18 has an electrical resistance between spaced points in a range between about 10 ohms/square to about 1,000 ohms/square. In one embodiment, the spaced points are separated by a distance in a range between about 0.5 cm to about 10 cm with about 1 cm to about 5 cm being more preferred. Although virtually any resistance can be used, the above range requires TFC 18 to be deposited using sophisticated equipment yet the resistance can be measured using a relatively inexpensive detector as discussed below.

If desired, once TFC 18 is formed, TFC 18 can be patterned. Patterning is used to affect the thickness and/or visual appearance of TFC 18. Patterning can be accomplished by using processes such as sandblasting, laser cutting, etching, or other processes used in chip manufacturing. Examples of patterning include the formation of holes, slots, grooves, pocks, ridges, or other configurations on or through TFC 18. Alternatively, TFC 18 can initially be formed in patterns using, for example, masks or molds. The visual appearance of TFC 18 can then also function as an authenticating feature for article 10.

Printing 20, such as lettering or images, can be applied over at least a portion of TFC 18 if desired. Printing 20 can be any desired configuration or thickness. Likewise printing 20 can be composed of any printing materials such as paint, ink, or graphite compositions. Likewise, printing 20 can be applied manually, using air or airless sprayers, or using laser or other types of printers. For reasons as will be discussed later in greater detail, printing 20 needs to leave at least two spaced apart openings 19 and 21 which expose TFC 18.

Figure 3:
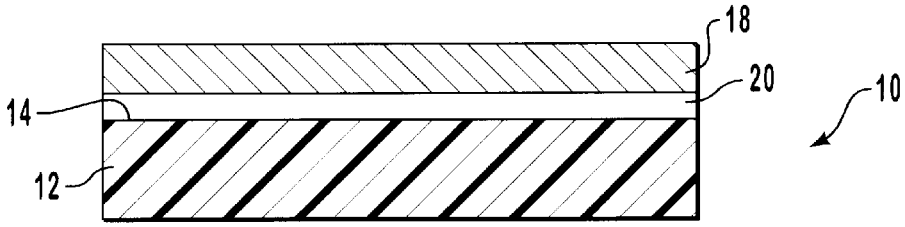
FIG. 3 is a cross-sectional side view of an alternative embodiment of the security article shown in FIG. 1.

In an alternative embodiment as depicted in FIG. 3, printing 20 can be positioned on top surface 14 of substrate layer 12. Next, TFC 18 can be deposited over top of printing 20. In this embodiment, printing 20 need not form openings 19 and 21 since TFC 18 is openly exposed. However, to enable printing 20 to be visible, it is necessary that TFC 18 be comprised of a transparent conductive compound as previously discussed. In yet other alternative embodiments, printing 20 and TFC 18 can be positioned on discrete portions of top surface 14 of substrate layer 12 such that the two elements do not overlap.

The present invention envisions that article 10 can comprise a variety of alternative configurations. For example, article 10 can comprise coupons, stamps, credit cards, identification cards, notes, stocks, seals, and other valuable documents. Article 10 can also comprise various types of containers such as boxes, bags, tubes, bottles, cartons, envelopes and other types of containers. In these embodiments, TFC 18 need not cover an entire surface of substrate layer 12 but need only cover a small portion thereof.

Figure 4:
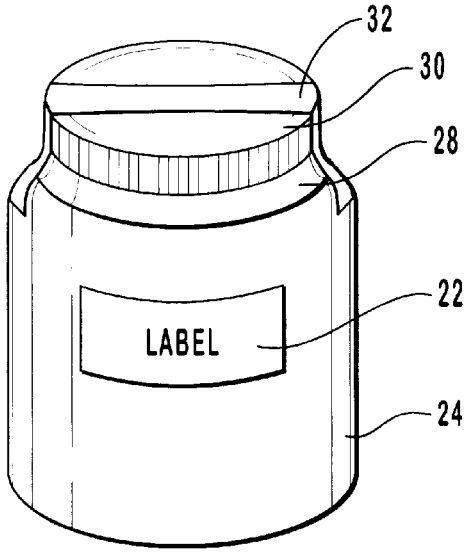
FIG. 4 perspective view of a product having an inventive security label disposed thereon.
Figure 5:
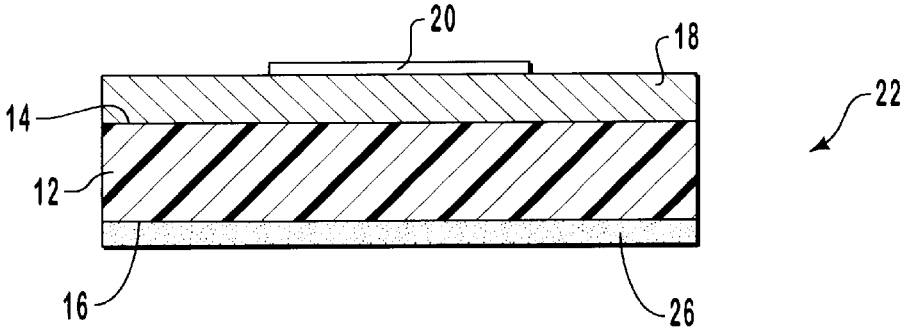
FIG. 5 is a cross-sectional side view of the security label shown in FIG. 4.

In an alternative embodiment, as depicted in FIG. 4, article 10 can comprise a label 22 which can be selectively attached to a discrete product such as a bottle 24. As depicted in FIG. 5, label 22 also includes a substrate layer 12 and TFC 18. If desired, printing 20 can also be used. Substrate layer 12, TFC 18, and printing 20 can be configured and comprised of the same materials as previously discussed with regard to article 10. In one embodiment of the present invention, however, means are provided for securing substrate layer 12 to a product. By way of example and not by limitation, an adhesive 26 can be applied to bottom surface 16 of substrate layer 12. Adhesive 26 can comprise conventional adhesives used on stickers. Examples of adhesive 26 include rubber cement, epoxy, and styrene-butadiene-styrene based polymers. In alternative embodiments, substrate layer 12 can be welded, tacked, cemented, or otherwise secured using other customary securing devices or approaches for securing substrate layer 12 to a product.

It is envisioned that label 22 can be attached to virtually any desired object. There are several benefits of using label 22 as opposed to depositing TFC 18 directly on an article. Most notably, most deposition processes require special equipment housed in a unique environment. For example, PVD is accomplished in a relative vacuum. Having to transport large amounts of large products through such facilities is time consuming and expensive. Likewise, some products may be damaged if subject to a relative vacuum.

In one embodiment, as depicted in FIG. 4, security article 10 can comprise a shrink wrap 28 which seals a lid 30 to bottle 24. In alternative embodiments, shrink wrap can completely enclose a product. In yet other embodiments, security article 10 can comprise a seal 32 for containers or bottles.

As previously discussed, by varying select factors, TFC 18 can be formed having virtually any predetermined resistance between spaced points or resistivity over a defined surface area. This predetermined resistance is an authenticating property of security article 10 or of the product on which security article 10 is placed. That is, by making a specific security article 10 have a unique and specific resistance, the resistance becomes a unique property of security article 10 which can be used to authenticate the article.

In embodiments where TFC 18 has a constant thickness and material composition, the electrical resistance produced by the TFC should be substantially the same between any two points of equal separation. Under normal manufacturing tolerances, the difference between compared resistances in such embodiments is typically less than about 15% and more preferably less than about 10%. In embodiments where TFC 18 does not have constant thickness or electrical properties, it may be necessary to define the points on TFC 18 where the resistance is to be measured.

Figure 6:
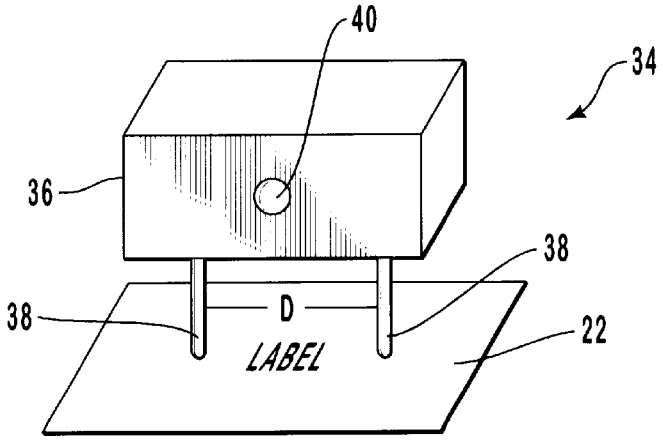
FIG. 6 is a perspective view of a detector disposed against the security label shown in FIG. 4.

In one embodiment of the present invention, means are provided for determining whether TFC 18 produces the predetermined electrical resistance between two spaced apart points. By way of example and not by limitation, depicted in FIG. 6 is one embodiment of a detector 34. Detector 34 comprises a housing 36 having a pair of probes 38 rigidly projecting therefrom. Probes 38 are separated by a distance D corresponding to the defined distance required to obtain the predetermined electrical resistance on TFC 18. Also attached to housing 36 is a signal 40. In one embodiment, signal 40 is a light. In alternative embodiments, signal 40 can be any kind of electrically operated device that can generate a signal to a user. For example, signal 40 can also be a bell, horn, display screen, or even a vibrator.

The present invention also includes means for applying a voltage differential between probes 38. By way of example and not by limitation, a battery 44, such as a nine volt battery, can be positioned within housing 36 and electrically coupled with probes 38. In an alternative embodiment, an electrical cable can be used to couple detector 34 to an electrical outlet.

Figure 7:
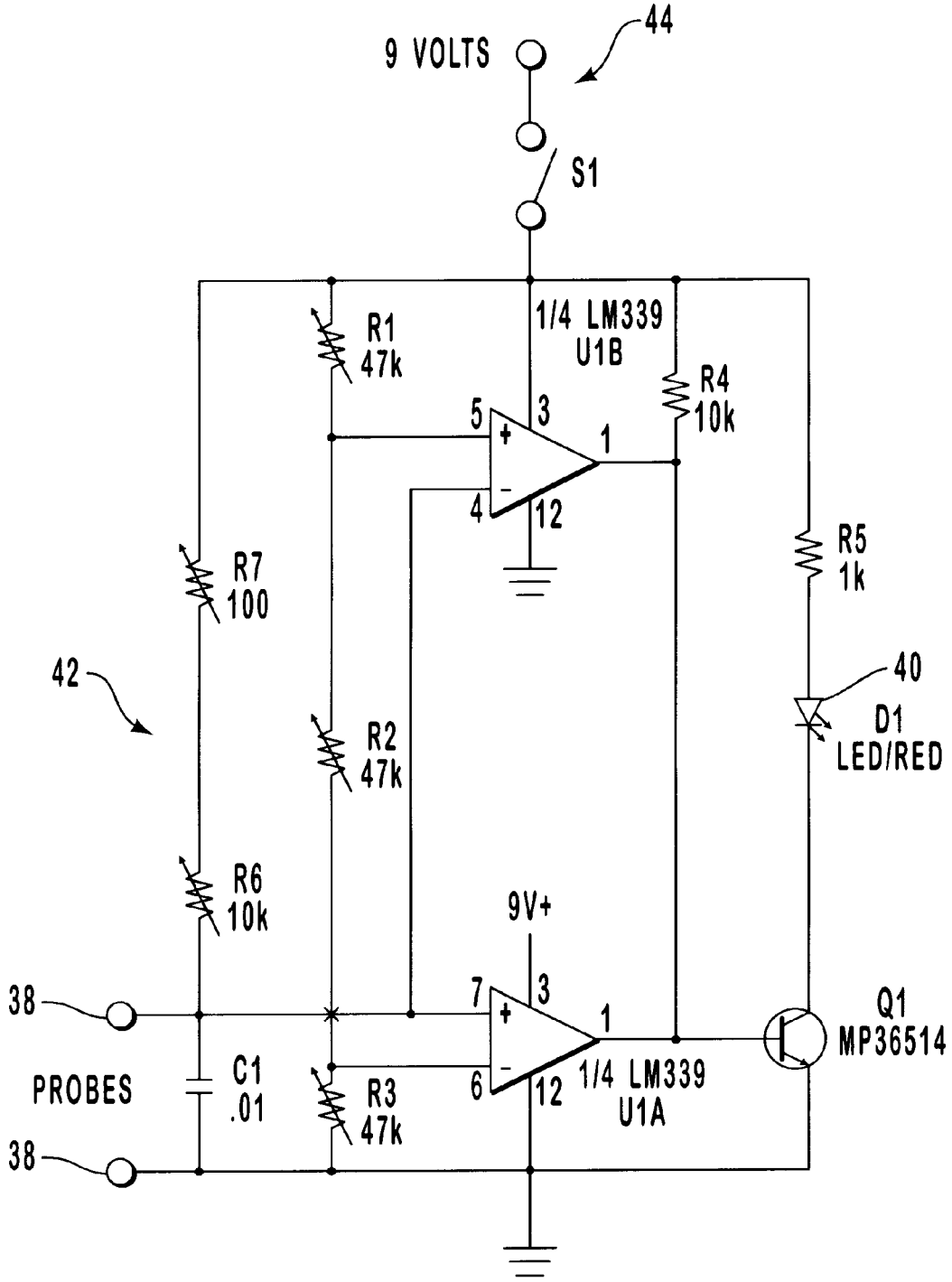
FIG. 7 is a schematic layout of the electrical components of the detector shown in FIG. 6.

Detector 34 also includes means for energizing signal 40 when the predetermined electrical resistance is produced between probes 38. By way of example and not by limitation, disposed within housing 36 and coupled to probes 38 and light 40 is electrical circuitry 42. As depicted in FIG. 7, in one embodiment electrical circuitry 42 comprises a window comparator circuit operated by battery 44.

Electrical circuitry 44 of detector 34 is configured to correspond to the expected or predetermined resistance that will be produced by TFC 18 when probes 38 are biased thereagainst. That is, electrical circuitry 44 is configured such that when probes 38 of detector 34 are biased against TFC 18, signal 40 of detector 34 is energized if the actual resistance produced by TFC 18 between probes 38 corresponds to the predetermined resistance. To account for manufacturing tolerances, the predetermined resistance is generally considered as being within an acceptable range of resistances. Energizing of signal 40 thus authenticates security article 10.

For example, TFC 18 can be configured to produce a resistance of 500 ohms when probes 38, separated by a distance of 4 cm, are biased against TFC 18 and a voltage differential is applied across probes 38. If when probes 38 are actually biased against TFC 18, the resulting resistance produced by TFC 18 is between 450 ohms and 550 ohms, electrical circuitry 44 energizes signal 40. If the actual voltage is either below 450 ohms or above 550 ohms, electrical circuitry 44 will not energize signal 40. If security article 10 has been counterfeited and the counterfeited article does not have a TFC or if the TFC does not have the predetermined resistance, signal 40 will not energize when probes 38 are biased thereagainst. Failure of signal 40 to energize is evidence that the article is a counterfeit or at least has been tampered with.

As previously discussed, when printing 20 is positioned over TFC 18, openings 19 and 21 can be formed through printing 20 to expose TFC 18. Openings 19 and 21 thus function to enable direct contact of probes 38 with TFC 18.

As an alternative to using detector 34, an ohm meter can also be used. Use of an ohm meter, however, requires that the testing party know the predetermined resistance and the distance apart at which the probes are to be placed. Furthermore, the ohm meter must be able to display the required resistance values. One of the benefits of detector 34 is that no adjustments or readings are required.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A security system comprising:

(a) a security article comprising (i) a substrate layer having a top surface; and (ii) a security feature having an authenticating property, the security feature comprising a thin film coating deposited on the top surface, the thin film coating comprising a transparent conductive compound and having a predetermined electrical resistance between two spaced apart points on the thin film coating, wherein the authenticating property is the predetermined electrical resistance, and wherein the presence of the security feature is not detectable by visual examination; and (b) means for authenticating the security article by determining whether the thin film coating has the predetermined electrical resistance between the two spaced apart points on the thin film coating.

2. A security system as recited in claim 1, wherein the substrate layer comprises a plastic.

3. A security system as recited in claim 1, wherein the thin film coating comprises indium tin oxide.

4. A security system as recited in claim 1, wherein the substrate layer has a bottom surface with an adhesive positioned thereon.

5. A security system as recited in claim 1, wherein the means for authenticating comprises a detector comprising a pair of spaced apart probes, means for applying a voltage differential across the probes, a signal device, and electrical circuitry coupling the probes and signal devices together, the electrical circuitry being configured to activate the signal device when the predetermined electrical resistance is produced between the probes.

6. A security system as recited in claim 1, further comprising printing positioned between the thin film coating and the substrate layer.

7. A security system comprising:

(a) a security article comprising:

(i) a substrate layer having a top surface; and (ii) a security feature having an authenticating property, the security feature comprising a conductive thin film coating deposited on the top surface, the thin film coating being deposited so as to have a substantially constant predetermined electrical resistance between any two equally spaced points on the thin film coating, wherein the authenticating property is the predetermined electrical resistance, and wherein the presence of the security feature is not detectable by visual examination; and (b) a detector comprising a pair of spaced apart probes, means for applying a voltage differential between the probes, a signal device, and means for energizing the signal device when the predetermined electrical resistance is produced between the probes.

8. A security system as recited in claim 7, wherein the thin film coating comprises a transparent conductive material.

9. A security system as recited in claim 7, wherein the thin film coating comprises an opaque conductive material.

10. A security system as recited in claim 7, wherein printing is positioned over a portion of the thin film coating.

11. A security system as recited in claim 7, wherein the thin film coating has an electrical resistance in a range between about 10 ohms/square to about 1000 ohms/square.

12. A security system as recited in claim 7, wherein the means for energizing the signal device comprises a window comparator circuit.

13. A security system as recited in claim 7, wherein the signal device comprises a light.

14. A security system for use with a product, the system comprising:

(a) a label comprising:

(i) a substrate layer having a top surface and a bottom surface;

(ii) a security feature having an authenticating property, the security feature comprising a conductive thin film coating deposited on the top surface of the substrate layer, the thin film coating having a predetermined electrical resistance between two spaced apart points thereon; and (iii) means for securing the bottom surface of the substrate layer to the product, wherein the authenticating property is the predetermined electrical resistance, and wherein the presence of the security feature is not detectable by visual examination; and (b) a detector comprising a pair of spaced apart probes, means for applying a voltage differential across the probes, a signal device, and electrical circuitry coupling the probes and signal device together, the electrical circuitry being configured to activate the signal device when the predetermined electrical resistance is produced between the probes.

15. A security system as recited in claim 14, further comprising printing positioned over a portion of the thin film coating.

16. A security system as recited in claim 14, wherein the thin film coating comprises a conductive transparent material.

17. A security system as recited in claim 14, wherein the substrate layer comprises paper.

18. A security system as recited in claim 14, wherein the thin film coating has a thickness in a range between about 7 nanometers to about 700 nanometers.

19. A detector for authenticating a conductive security article, the security article having a predetermined electrical resistance between two spaced apart points thereon, the detector comprising:

(a) a housing bounding a compartment;

(b) a pair of spaced apart probes rigidly projecting from the housing;

(c) means for applying a voltage differential between the probes;

(d) a signal device mounted to the housing; and (e) electrical circuitry coupling the probes and the signal device and disposed within the compartment of the housing, the electrical circuitry being configured to energize the signal device when the predetermined electrical resistance is obtained between the probes;

wherein the detector is capable of authenticating a security article having a security feature the presence of which is not detectable by visual examination.

20. A detector as recited in claim 19, wherein the signal device is a light.

* * * * *